US010637212B2

(12) United States Patent
Uegaki et al.

(10) Patent No.: US 10,637,212 B2
(45) Date of Patent: Apr. 28, 2020

(54) METHOD FOR MANUFACTURING INSULATOR FOR SPARK PLUG

(71) Applicant: NGK SPARK PLUG CO., LTD., Nagoya-shi, Aichi (JP)

(72) Inventors: Hironori Uegaki, Nagoya (JP); Hirokazu Kurono, Nagoya (JP); Toshitaka Honda, Nagoya (JP); Hiroyuki Hazama, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 286 days.

(21) Appl. No.: 15/521,740

(22) PCT Filed: Sep. 23, 2015

(86) PCT No.: PCT/JP2015/004822
§ 371 (c)(1),
(2) Date: Apr. 25, 2017

(87) PCT Pub. No.: WO2016/067515
PCT Pub. Date: May 6, 2016

(65) Prior Publication Data

US 2017/0250523 A1 Aug. 31, 2017

(30) Foreign Application Priority Data

Oct. 27, 2014 (JP) ..... 2014-218406

(51) Int. Cl.
*B28B 1/24* (2006.01)
*H01T 21/02* (2006.01)
(Continued)

(52) U.S. Cl.
CPC ..... *H01T 13/20* (2013.01); *B28B 1/24* (2013.01); *B28B 7/18* (2013.01); *B28B 13/02* (2013.01); *B28B 13/021* (2013.01); *H01T 21/02* (2013.01)

(58) Field of Classification Search
CPC ..... B29C 45/27
(Continued)

(56) References Cited

U.S. PATENT DOCUMENTS

2011/0262713 A1* 10/2011 Nakao ..... B29C 45/0025 428/174
2016/0263797 A1* 9/2016 Bessho ..... B29C 45/0025

FOREIGN PATENT DOCUMENTS

DE 102010042155 A1 4/2012 ..... B28B 1/24
DE 102012200045 A1 7/2013 ..... B28B 1/24
(Continued)

OTHER PUBLICATIONS

English Translation of Loibl (WO2013102514) (Year: 2013).*
"Injection Molding." Available on Aug. 1, 2014. <https://www.m-ep.co.jp/en/pdf/product/novaduran/molding.pdf> (Year: 2014).*
Injection Molding Handbook. Rosato. Springer US. 2000 (Year: 2000).*
"Case studies of injection molded part design." Available Feb. 2004. <http://www.me.umn.edu/~kstelson/research_sbp/sbp/case/case_ex3.html> (Year: 2004).*
(Continued)

*Primary Examiner* — Matthew J Daniels
*Assistant Examiner* — Hana C Page
(74) *Attorney, Agent, or Firm* — Kusner & Jaffe

(57) ABSTRACT

A method for manufacturing an insulator for a spark plug includes a molding process of forming a cylindrical molded product having an axial hole that extends in a direction of an axial line, by means of injection molding using a mold that has a columnar cavity therein and a bar-shaped member disposed in the cavity and extending in the direction of the axial line. In this method, the molding process includes an injection step of injecting a material containing a ceramic. In the injection step, the material is injected into the cavity from a plurality of injection openings that are opened at an inner circumferential surface, of the mold, that forms the
(Continued)

THIRD EMBODIMENT cavity. The plurality of injection openings include two or more injection openings located at different positions in the direction of the axial line, or two or more injection openings located at different positions in a circumferential direction.

7 Claims, 8 Drawing Sheets

(51) Int. Cl.
*B28B 13/02* (2006.01)
*H01T 13/20* (2006.01)
*B28B 7/18* (2006.01)

(58) Field of Classification Search
USPC ..... 264/328
See application file for complete search history.

(56) References Cited

FOREIGN PATENT DOCUMENTS

| | | | | |
|---|---|---|---|---|
| EP | 2800655 A1 | 11/2014 | ..... | B28B 1/24 |
| JP | 59-120404 | 7/1984 | ..... | B28B 1/24 |
| JP | 03-202307 | 9/1991 | ..... | B28B 1/24 |
| WO | WO 2013/102514 A1 | 7/2013 | ..... | B28B 1/24 |

OTHER PUBLICATIONS

Kamagai. English Translation of JPH032202307 (Year: 1989).*
International Search Report issued in corresponding International Patent Application No. PCT/JP2015/004822, dated Dec. 22, 2015.

* cited by examiner

FIRST EMBODIMENT

SECOND EMBODIMENT

THIRD EMBODIMENT

FOURTH EMBODIMENT

FIFTH EMBODIMENT

SIXTH EMBODIMENT

SEVENTH EMBODIMENT

EIGHTH EMBODIMENT

NINTH EMBODIMENT

TENTH EMBODIMENT

METHOD FOR MANUFACTURING INSULATOR FOR SPARK PLUG

RELATED APPLICATIONS

This application is a National Stage of International Application No. PCT/JP2015/04822 filed Sep. 23, 2015, which claims the benefit of Japanese Patent Application No. 2014-218406, filed Oct. 27, 2014.

FIELD OF THE INVENTION

The present invention relates to a method for manufacturing insulators for spark plugs used for ignition in internal combustion engines and the like.

BACKGROUND OF THE INVENTION

A technique of forming an insulator for a spark plug by injection molding using a material obtained by mixing ceramic and resin has been known (e.g., German Patent Application Laid-Open Publication No. 102010042155 (DE10 2010 042 155 A1) and German Patent Application Laid-Open Publication No. 102012200045 (DE10 2012 200 045 A1)).

According to the technique disclosed in German Patent Application Laid-Open Publication No. 102010042155 (DE10 2010 042 155 A1), injection of a material into a cavity of a mold is performed from a position corresponding to a front end, in an axial direction, of an insulator. According to the technique disclosed in German Patent Application Laid-Open Publication No. 102012200045 (DE10 2012 200 045 A1), injection of a material into a cavity of a mold is performed from one position corresponding to a portion, having a maximum outer diameter, of an insulator.

In the above-described techniques, however, the material injection position is not sufficiently contrived, and there is a possibility of reduction in dielectric strength properties of manufactured insulators. For example, the material injection position of German Patent Application Laid-Open Publication No. 102010042155 (DE10 2010 042 155 A1) may cause insufficient density of a rear end portion, of the insulator, farthest from the injection position, and the insufficient density may reduce dielectric strength property of the rear end portion of the insulator. Meanwhile, in the German Patent Application Laid-Open Publication No. 102012200045 (DE10 2012 200 045 A1), since the material injection position is only one, the distance in which the material moves to reach a rear end portion or a front end portion of the insulator is long. As a result, density of the front end portion or the rear end portion of the insulator is insufficient, and the insufficient density may reduce dielectric strength property of the front end portion or the rear end portion of the insulator.

An advantage of the present invention is to suppress reduction in dielectric strength property of an insulator when the insulator is formed by injection molding.

SUMMARY OF THE INVENTION

The present invention is made to address, at least partially, the above problem, and can be embodied in the following modes or application examples.

APPLICATION EXAMPLE 1

In accordance with a first aspect of the present invention, there is provided a method for manufacturing an insulator for a spark plug, wherein the method includes a molding process of forming a cylindrical molded product having an axial hole that extends in a direction of an axial line, by means of injection molding using a mold that has a columnar cavity therein, and a bar-shaped member disposed in the cavity and extending in the direction of the axial line, wherein the molding process includes an injection step of injecting a material containing a ceramic, in the injection step, the material is injected into the cavity from a plurality of injection openings that are opened at an inner circumferential surface, of the mold, that forms the cavity, and the plurality of injection openings include two or more injection openings located at different positions in the direction of the axial line.

According to the above configuration, the material is injected into the cavity from the plurality of injection openings located at different positions in the direction of the axial line. As a result, the movement distance of the material, which is needed to fill up the cavity up to the front end and the rear end thereof with the material, can be reduced. Therefore, it is possible to suppress reduction in density of the front end and rear end of the molded product, which reduction may be caused by increase in pressure loss while the material moves. As a result, in an insulator for a spark plug, which is manufactured by using the molded product, reduction in dielectric strength property of the front end and the rear end of the insulator can be suppressed. Further, since the material is injected from the position corresponding to the inner circumferential surface of the cavity, in other words, the side surface of the molded product, occurrence of burrs at the front end of the molded product can be suppressed. As a result, a process of removing burrs is dispensed with, thereby preventing occurrence of crack and/or breaking which may be caused by removal of such burrs.

APPLICATION EXAMPLE 2

In accordance with a second aspect of the present invention, there is provided a method for manufacturing the insulator for the spark plug, as described above, wherein the plurality of injection openings include two or more injection openings located at different positions in a circumferential direction at the inner circumferential surface, of the mold, that forms the cavity.

According to the above configuration, when the material is injected into the cavity, the movement distance in which the material moves in the circumferential direction can be reduced. As a result, local reduction in density of the molded product can be further suppressed. Therefore, in the insulator for the spark plug, which is manufactured by using the molded product, reduction in dielectric strength property can be suppressed.

APPLICATION EXAMPLE 3

In accordance with a third aspect of the present invention, there is provided a method for manufacturing an insulator for a spark plug, as described above, wherein the method including a molding process of forming a cylindrical molded product having an axial hole that extends in a direction of an axial line, by means of injection molding using a mold that has a columnar cavity therein, and a bar-shaped member disposed in the cavity and extending in the direction of the axial line, wherein the molding process includes an injection step of injecting a material containing a ceramic, in the injection step, the material is injected into the cavity from a plurality of injection openings that are opened at an inner circumferential surface, of the mold, that forms the cavity, and the plurality of injection openings include two or more injection openings located at different positions in a circumferential direction at the inner circumferential surface, of the mold, that forms the cavity.

According to the above configuration, the material is injected into the cavity from the plurality of injection openings located at the different positions in the circumferential direction at the inner circumferential surface, of the mold, that forms the cavity. As a result, the movement distance of the material, which is needed to fill up the cavity up to the front end and the rear end thereof with the material, can be reduced. Therefore, it is possible to suppress reduction in density of the front end and the rear end of the molded product, which reduction may be caused by reduction in material temperature while the material moves. As a result, in an insulator for a spark plug, which is manufactured by using the molded product, reduction in dielectric strength property of the front end and the rear end of the insulator can be suppressed. Further, since the material is injected from the position corresponding to the inner circumferential surface of the cavity, in other words, the side surface of the molded product, occurrence of burrs at the front end of the molded product can be suppressed. As a result, a process of removing burrs is dispensed with, thereby preventing occurrence of crack and/or breaking which may be caused by removal of such burrs.

APPLICATION EXAMPLE 4

In accordance with a fourth aspect of the present invention, there is provided a method for manufacturing the insulator for the spark plug, as described above, wherein the plurality of injection openings are located so that angles thereof in the circumferential direction between the adjacent injection openings in the circumferential direction are equal to each other.

According to the above configuration, when the material is injected into the cavity, the movement distance in which the material moves in the circumferential direction can be further reduced. Therefore, in the insulator for the spark plug, which is manufactured by using the molded product, reduction in dielectric strength property can be suppressed more effectively.

APPLICATION EXAMPLE 5

In accordance with a fifth aspect of the present invention, there is provided a method for manufacturing the insulator for the spark plug, as described above, wherein the plurality of injection openings are arranged in a helical manner at the inner circumferential surface, of the mold, that forms the cavity.

According to the above configuration, when the material is injected into the cavity, the movement distance in which the material moves in the circumferential direction can be further reduced. Therefore, in the insulator for the spark plug, which is manufactured by using the molded product, reduction in dielectric strength property can be suppressed more effectively.

APPLICATION EXAMPLE 6

In accordance with a sixth aspect of the present invention, there is provided a method for manufacturing the insulator for the spark plug, as described above, wherein at least one of the plurality of injection openings is located at a position, in the direction of the axial line, where the cavity has a maximum inner diameter.

At the position, in the direction of the axial line, where the cavity has the maximum inner diameter, the movement distance of the material in the circumferential direction is maximum. Therefore, when the material is injected into the cavity, the movement distance in which the material moves in the circumferential direction is maximum at this position. According to the above configuration, since at least one injection opening is located at this position, the movement distance in which the material moves in the circumferential direction can be reduced at this position. Therefore, in the insulator for the spark plug, which is manufactured by using the molded product, reduction in dielectric strength property can be suppressed more effectively.

APPLICATION EXAMPLE 7

In accordance with a seventh aspect of the present invention, there is provided a method for manufacturing the insulator for the spark plug, as described above, wherein at least two of the plurality of injection openings are located at the same position in the direction of the axial line.

According to the above configuration, the movement distance of the material can be further reduced at the position, in the direction of the axial line, where the at least two injection openings are located. Therefore, in the insulator of the spark plug, which is manufactured by using the molded product, reduction in dielectric strength property at this position can be suppressed more effectively.

APPLICATION EXAMPLE 8

In accordance with an eighth aspect of the present invention, there is provided a method for manufacturing the insulator for the spark plug, as described above, wherein at least two injection openings, the positions in the direction of the axial line of which are the same, are located at the position, in the direction of the axial line, at which the cavity has the maximum inner diameter.

According to the above configuration, since the at least two injection openings are located in the portion where the movement distance of the material tends to be long, the movement distance of the material can be effectively reduced. Therefore, in an insulator of a spark plug, which is manufactured by using the molded product, reduction in dielectric strength property at this position can be suppressed more effectively.

The present invention can be implemented in various forms. For example, the present invention may be implemented as a method for manufacturing a spark plug, a mold for injection molding used for manufacturing an insulator for a spark plug, a spark plug manufactured by using the method or the mold, and the like.

DETAILED DESCRIPTION OF THE PREFERRED EMBODIMENTS

A. First Embodiment

Figure 1:
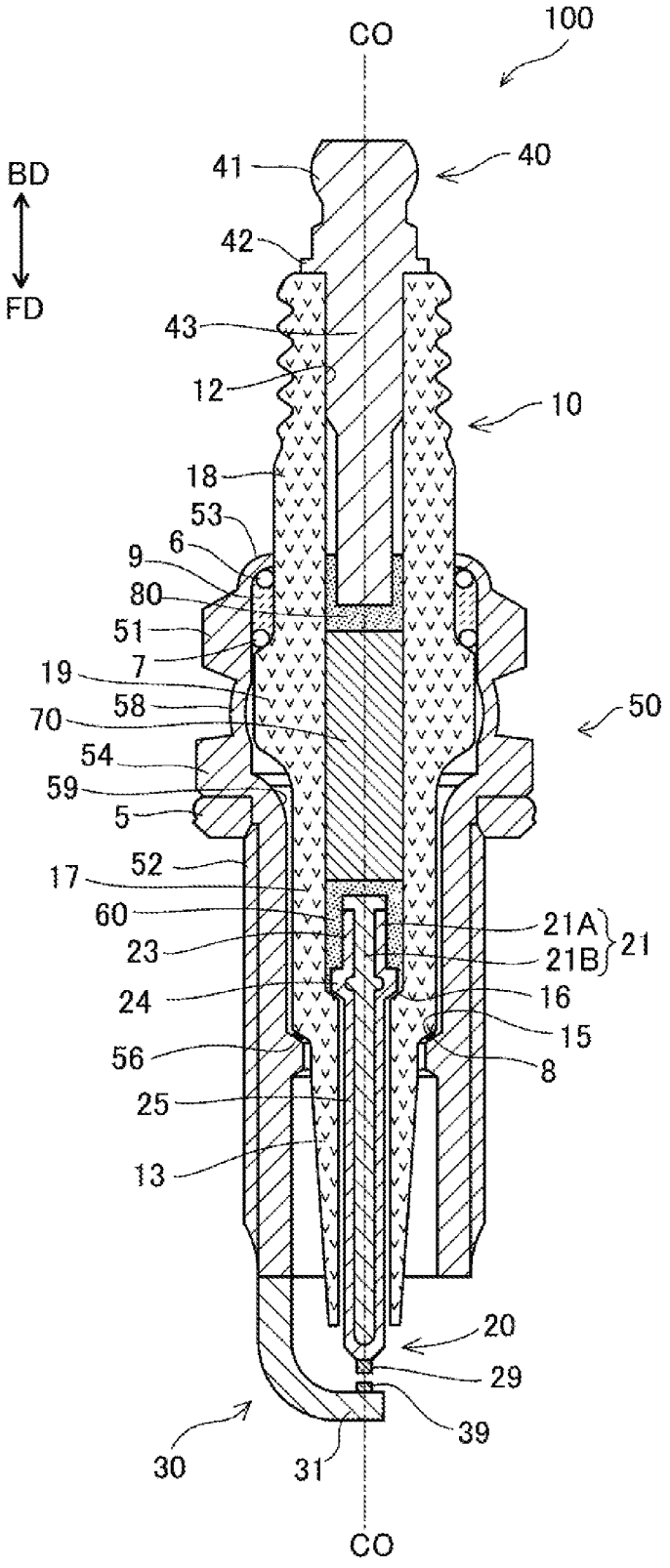
FIG. 1 is a cross-sectional view of a spark plug 100 according to an embodiment of the present invention.

A-1. Structure of Spark Plug:

Hereinafter, a mode of the present invention will be described on the basis of an embodiment. FIG. 1 is a cross-sectional view of a spark plug 100 according to the present embodiment. In FIG. 1, an alternate long and short dashed line indicates an axial line CO of the spark plug 100 (also referred to as an axial line CO). The direction parallel to the axial line CO (an up-down direction in FIG. 1) is also referred to as an axial direction. The radial direction of a circle centered on the axial line CO is also referred to simply as a "radial direction", and the circumferential direction of the circle centered on the axial line CO is also referred to simply as a "circumferential direction". In FIG. 1, the downward direction is also referred to as a front end direction FD, and the upward direction is also referred to as a rear end direction BD. In FIG. 1, the lower side is referred to as a front side of the spark plug 100, and the upper side is referred to as a rear side of the spark plug 100. The spark plug 100 includes an insulator 10 as an insulator, a center electrode 20, a ground electrode 30, a metal terminal 40, and a metal shell 50.

The insulator (ceramic insulator) 10 is formed by baking alumina or the like. The insulator 10 is a substantially cylindrical member having a through-hole 12 (axial hole) extending along the axial direction and through the insulator 10. The insulator 10 includes a flange portion 19, a rear trunk portion 18, a front trunk portion 17, a step portion 15, and a leg portion 13. The rear trunk portion 18 is located at the rear side with respect to the flange portion 19 and has an outer diameter smaller than the outer diameter of the flange portion 19. The front trunk portion 17 is located at the front side with respect to the flange portion 19 and has an outer diameter smaller than the outer diameter of the flange portion 19. The leg portion 13 is located at the front side with respect to the front trunk portion 17, has an outer diameter smaller than the outer diameter of the front trunk portion 17. The leg portion 13 is exposed to a combustion chamber of an internal combustion engine (not shown) when the spark plug 100 is mounted on the internal combustion engine. The step portion 15 is formed between the leg portion 13 and the front trunk portion 17.

The metal shell 50 is formed from a conductive metal material (e.g., a low-carbon steel material). The metal shell 50 is a cylindrical metal member for fixing the spark plug 100 to an engine head (not shown) of the internal combustion engine. The metal shell 50 has an insertion hole 59 extending along the axial line CO and through the metal shell 50. The metal shell 50 is disposed on the outer periphery of the insulator 10. That is, the insulator 10 is inserted and held in the insertion hole 59 of the metal shell 50. The front end of the insulator 10 protrudes toward the front side with respect to the front end of the metal shell 50. The rear end of the insulator 10 protrudes toward the rear side with respect to the rear end of the metal shell 50.

The metal shell 50 includes: a hexagonal columnar tool engagement portion 51 with which a spark plug wrench is engaged; a mounting screw portion 52 for mounting the spark plug 100 to an internal combustion engine; and a flange-like seat portion 54 formed between the tool engagement portion 51 and the mounting screw portion 52. The nominal diameter of the mounting screw portion 52 is, for example, any of M8 (8 mm (millimeters)), M10, M12, M14, and M18.

An annular gasket 5 which is formed by bending a metal plate is inserted between the mounting screw portion 52 and the seat portion 54 of the metal shell 50. The gasket 5 seals a gap between the spark plug 100 and the internal combustion engine (engine head) when the spark plug 100 is mounted on the internal combustion engine.

The metal shell 50 further includes: a thin crimp portion 53 provided at the rear side of the tool engagement portion 51; and a thin compressive deformation portion 58 provided between the seat portion 54 and the tool engagement portion 51. Annular ring members 6 and 7 are disposed in an annular region formed between: the inner circumferential surface of a portion of the metal shell 50 from the tool engagement portion 51 to the crimp portion 53; and the outer peripheral surface of the rear trunk portion 18 of the insulator 10. The space between the two ring members 6 and 7 in this region is filled with powder of a talc 9. The rear end of the crimp portion 53 is bent radially inward and fixed to the outer peripheral surface of the insulator 10. The compressive deformation portion 58 of the metal shell 50 is compressively deformed by the crimp portion 53, which is fixed to the outer peripheral surface of the insulator 10, being pressed toward the front side during manufacturing. The insulator 10 is pressed within the metal shell 50 toward the front side via the ring members 6 and 7 and the talc 9 due to the compressive deformation of the compressive deformation portion 58. The step portion 15 (ceramic insulator side step portion) of the insulator 10 is pressed by a step portion 56 (metal shell side step portion), which is formed on the inner periphery of the mounting screw portion 52 of the metal shell 50, via an annular plate packing 8 made of metal. As a result, the plate packing 8 prevents gas within the combustion chamber of the internal combustion engine from leaking to the outside through a gap between the metal shell 50 and the insulator 10.

The center electrode 20 includes: a bar-shaped center electrode body 21 extending in the axial direction; and a columnar center electrode tip 29 joined to the front end of the center electrode body 21. The center electrode body 21 is disposed within the through-hole 12 and at a front portion of the insulator 10. The center electrode body 21 has a structure including an electrode base material 21A, and a core portion 21B embedded in the electrode base material 21A. The electrode base material 21A is formed from, for example, nickel or an alloy containing nickel as a principal component. In the present embodiment, the electrode base material 21A is formed from INCONEL 600 ("INCONEL" is a registered trademark). The core portion 21B is formed from copper or an alloy containing copper as a principal component, having more excellent thermal conductivity than the alloy forming the electrode base material 21A. In the present embodiment, the core portion 21B is formed from copper.

The center electrode body 21 includes: a flange portion 24 (also referred to as a flange portion) provided at a predetermined position in the axial direction; a head portion 23 (electrode head portion) which is a portion at the rear side with respect to the flange portion 24; and a leg portion 25 (electrode leg portion) which is a portion at the front side with respect to the flange portion 24. The flange portion 24 is supported by a step portion 16 of the insulator 10. A front end portion of the leg portion 25, that is, the front end of the center electrode body 21 protrudes frontward of the front end of the insulator 10.

The center electrode tip 29 is joined to the front end of the center electrode body 21 (the front end of the leg portion 25), for example, by means of laser welding. The center electrode tip 29 is formed from a material containing, as a principal component, a noble metal having a high melting point. As the material of the center electrode tip 29, for example, iridium (Ir) or an alloy containing Ir as a principal component is used.

The ground electrode 30 includes: a ground electrode body 31 joined to the front end of the metal shell 50; and a columnar ground electrode tip 39.

The ground electrode body 31 is a bent bar-shaped body having a quadrangular cross-section. The rear end of the ground electrode body 31 is joined to the front end surface of the metal shell 50. Thus, the metal shell 50 and the ground electrode body 31 are electrically connected to each other. The front end of the ground electrode body 31 is a free end.

The ground electrode body 31 is formed by using a metal having high corrosion resistance, for example, a nickel alloy. In the present embodiment, the ground electrode body 31 is formed by using INCONEL 601. The ground electrode body 31 may include therein a core material formed from a metal, such as copper, having a higher coefficient of thermal conductivity than a nickel alloy.

The front end surface of the ground electrode tip 39 is joined to a surface, facing the center electrode 20, of a bent front end portion of the ground electrode body 31, for example, by means of resistance welding. The ground electrode tip 39 is formed by using, for example, Pt (platinum) or an alloy containing Pt as a principal component. In the present embodiment, the ground electrode tip 39 is formed by using a Pt-20Rh alloy (platinum alloy containing 20% by mass of rhodium) or the like.

The rear end surface of the ground electrode tip 39 and the front end surface of the center electrode tip 29 form a gap (also referred to as a gap) in which spark discharge occurs. The vicinity of the gap is also referred to a firing end of the spark plug 100.

The metal terminal 40 is a bar-shaped member extending in the axial direction. The metal terminal 40 is formed from a conductive metal material (e.g., low-carbon steel), and a metal layer (e.g., an Ni layer) for anticorrosion is formed on the surface of the metal terminal 40 by means of plating or the like. The metal terminal 40 includes: a flange portion 42 (terminal jaw portion) formed in a predetermined position in the axial direction; a cap mounting portion 41 located at the rear side with respect to the flange portion 42; and a leg portion 43 (terminal leg portion) located at the front side with respect to the flange portion 42. The cap mounting portion 41 of the metal terminal 40 is exposed to the rear side with respect to the insulator 10. The leg portion 43 of the metal terminal 40 is inserted into the through-hole 12 of the insulator 10. A plug cap to which a high-voltage cable (not shown) is connected is mounted on the cap mounting portion 41, and a high voltage for causing spark discharge is applied to the plug cap.

A resistor 70 for reducing electric wave noise generated when spark occurs is disposed within the through-hole 12 of the insulator 10 and between the front end of the metal terminal 40 (the front end of the trunk portion 43) and the rear end of the center electrode 20 (the rear end of the head portion 23). The resistor 70 is formed from, for example, a composition containing glass particles as a principal component, ceramic particles other than glass, and a conductive material. Within the through-hole 12, a gap between the resistor 70 and the center electrode 20 is filled with a conductive seal 60, and a gap between the resistor 70 and the metal terminal 40 is filled with a conductive seal 80. Each of the conductive seals 60 and 80 is formed from, for example, a composition containing glass particles of a $B_2O_3$—$SiO_2$-based material or the like and metal particles (Cu, Fe, etc.).

A-2. Method of Manufacturing Insulator 10

Figure 2:
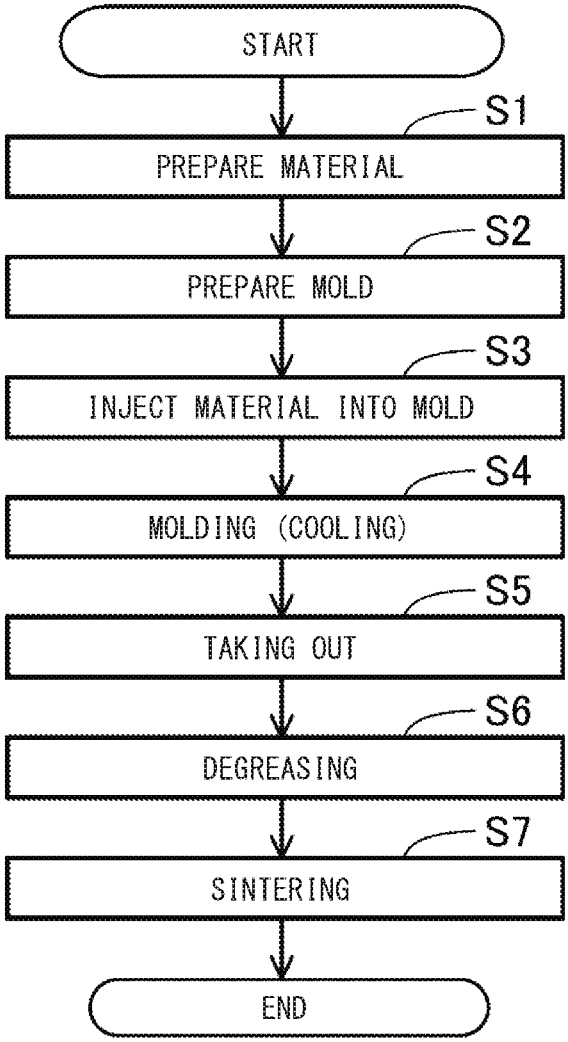
FIG. 2 is a flowchart showing a process of manufacturing an insulator 10.

Next, a method for manufacturing the insulator 10 of the spark plug 100 will be described. In this embodiment, the insulator 10 is manufactured by injection molding. FIG. 2 is a flowchart showing the method for manufacturing the insulator 10.

At S1, first, a material for injection molding of the insulator 10 is prepared. This material is produced by, for example, grinding and mixing ceramic powder and a binder by means of a ball mill. The ceramic powder contains powder of alumina ($Al_2O_3$) as a principal component of the insulator 10, and powder of a sintering additive (e.g., $La_2O_3$, $SiO_2$, SiC, $TiO_2$, $Y_2O_3$, CaO, or MgO). As the binder, for example, a polyamide resin or a cellulose resin is used. The weight ratio of the ceramic powder and the binder is, for example, 7:3 to 9:1.

Figure 3A:
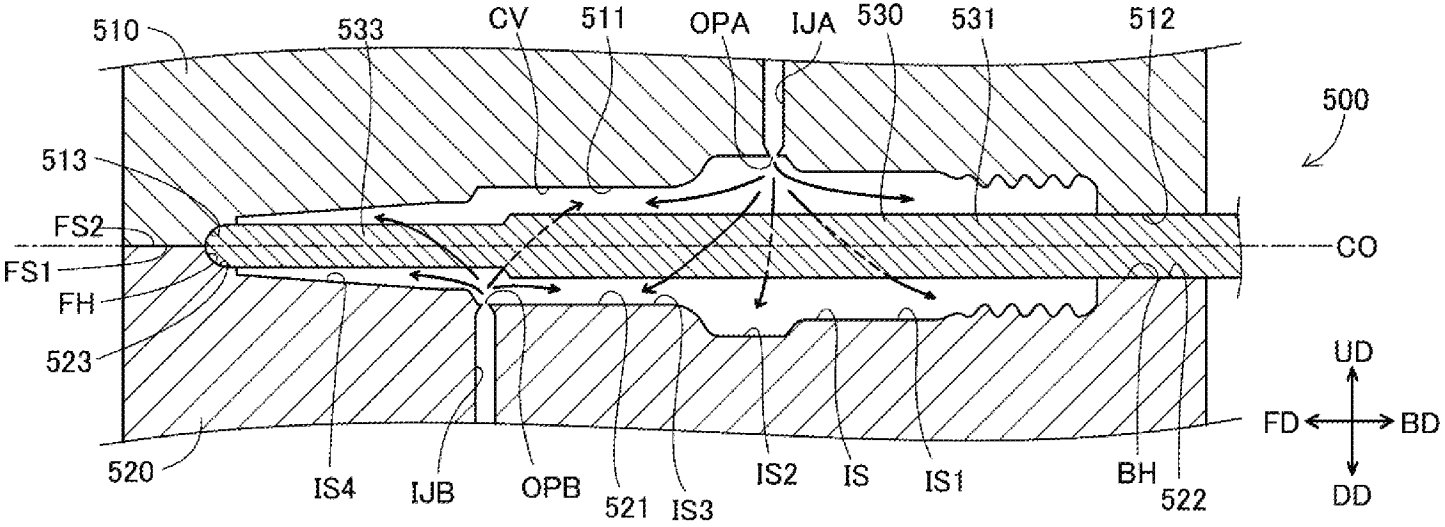
FIGS. 3(A) and 3(B) are diagrams showing a mold 500 used for molding of the insulator 10.
Figure 3B:
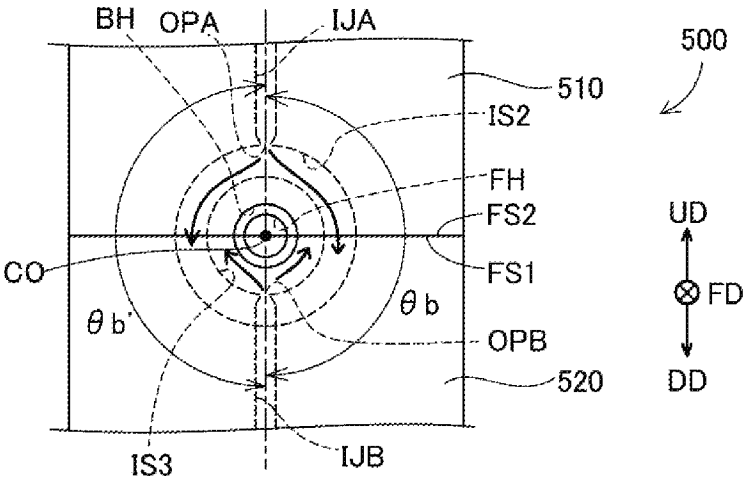

At S2, a mold is prepared. FIG. 3 shows a mold 500 used for molding of the insulator 10. FIG. 3(A) is a cross-sectional view of the mold 500 taken along a plane that includes an axial line CO (described later) and is perpendicular to mating surfaces FS1 and FS2 (described later) of the mold 500. FIG. 3(B) shows the mold 500 as seen from the rear side toward a front end direction FD (described later) along the axial line CO. The mold 500 includes a plurality of members, i.e., an upper mold 510, a lower mold 520, and a bar-shaped member 530. The upper mold 510 includes the mating surface FS1 to be mated with the lower mold 520, and the lower mold 520 includes the mating surface FS2 to be mated with the upper mold 510. A direction from the lower mold 520 toward the upper mold 510, perpendicular to the mating surfaces FS1 and FS2, is referred to as an upward direction UD, and a direction from the upper mold 510 toward the lower mold 520, perpendicular to the mating surfaces FS1 and SF2, is referred to as a downward direction DD (FIG. 3).

The upper mold 510 has, at the lower side (in the downward direction DD), an upper cavity forming surface 511 which forms a cavity having a shape corresponding to the shape of the insulator 10. The lower mold 520 has, at the upper side (in the upward direction UD), a lower cavity forming surface 521 which forms a cavity having a shape corresponding to the shape of the insulator 10. When the mold 500 (the upper mold 510 and the lower mold 520) is closed such that the mating surface FS1 of the upper mold 510 comes into contact with the mating surface FS2 of the lower mold 520, a cavity CV having the outer shape of the insulator 10, that is, a substantially columnar shape, is formed inside the mold 500 by the upper cavity forming surface 511 and the lower cavity forming surface 521. In the following description, the upper cavity forming surface 511 and the lower cavity forming surface 521 as a whole may be referred to simply as a "cavity forming surface IS".

As shown in FIG. 3(A), since the cavity CV has the outer shape of the insulator 10, the axial line and directions of the cavity CV and the cavity forming surface IS are expressed in a similar manner to those of the insulator 10 formed inside the cavity CV. For example, an axial line CO of the insulator 10 formed inside the cavity CV is referred to as an axial line CO (FIG. 3(A)) of the cavity CV and the cavity forming surface IS. A direction parallel to the axial line CO is referred to as an axial direction. Of the axial direction, a front end direction FD (leftward direction in FIG. 3(A)) of the insulator 10 formed inside the cavity CV is referred to simply as a front end direction FD. Likewise, a rear end direction BD (rightward direction in FIG. 3(A)) of the insulator 10 formed inside the cavity CV is referred to simply as a rear end direction BD. A radial direction of a circle, centered on the axial line CO, on a plane perpendicular to the axial line CO is also referred to simply as a "radial direction", and a circumferential direction of the circle centered on the axial line CO is also referred to simply as a "circumferential direction".

As shown in FIG. 3(A), the cavity forming surface IS includes: a maximum diameter portion IS2 having a maximum inner diameter; a rear side small diameter portion IS1 located at the rear side with respect to the maximum diameter portion; a front side small diameter portion IS3 located at the front side with respect to the maximum diameter portion IS2; and a diameter-decreasing portion IS4 located at the front side with respect to the front side small diameter portion IS3. The inner diameter of the rear side small diameter portion IS1 and the inner diameter of the front side small diameter portion IS3 are smaller than the inner diameter of the maximum diameter portion IS2. The inner diameter of the diameter-decreasing portion IS4 is smaller than the inner diameter of the front side small diameter portion IS3, and decreases from the rear end toward the front end direction FD. The maximum diameter portion IS2 corresponds to the flange portion 19 (FIG. 1) which is a portion, of the insulator 10, having the maximum outer diameter. The rear side small diameter portion IS1, the front side small diameter portion IS3, and the diameter-decreasing portion IS4 correspond to the rear trunk portion 18, the front trunk portion 17, and the leg portion 13, respectively, of the insulator 10 (FIG. 1).

Further, the upper mold 510 has an upper rear end hole forming surface 512, and the lower mold 520 has a lower rear end hole forming surface 522. With the upper mold 510 and the lower mold 520 being closed, a rear end hole BH is formed by the upper rear end hole forming surface 512 of the upper mold 510 and the lower rear end hole forming surface 522 of the lower mold 520. The rear end hole BH is a cylindrical through-hole having the axial line CO as a center axis. The front end of the rear end hole BH communicates with the rear end of the cavity CV, and the rear end of the rear end hole BH communicates with the outside. The upper rear end hole forming surface 512 and the lower rear end hole forming surface 522 as a whole may be referred to simply as a "rear end hole forming surface".

Further, the upper mold 510 has an upper front end hole forming surface 513, and the lower mold 520*a* has a lower front end hole forming surface 523. With the upper mold 510 and the lower mold 520 being closed, a front end hole FH is formed by the upper front end hole forming surface 513 of the upper mold 510 and the lower front end hole forming surface 523 of the lower mold 520. The front end hole FH is a bottomed hole (non-through-hole) having the axial line CO as a center axis. The rear end of the front end hole FH communicates with the front end of the cavity CV, and the front end of the front end hole FH is closed. The upper front end hole forming surface 513 and the lower front end hole forming surface 523 as a whole may be referred to simply as a "front end hole forming surface".

A plurality of injection openings OP are formed in the mold 500. Specifically, in the upper mold 510, a first injection path IJA for injecting a material into the cavity CV is formed. One end (end on the radially inner side) of the first injection path IJA communicates with the cavity CV. That is, one end of the first injection path IJA is a first injection opening OPA which is opened at the cavity forming surface IS. The other end (not shown) of the first injection path IJA communicates with a material charge port (not shown) provided in the mold 500.

Likewise, in the lower mold 520, a second injection path IJB for injecting the material into the cavity CV is formed. One end (end on the radially inner side) of the second injection path IJB communicates with the cavity CV. That is, one end of the second injection path IJB is a second injection opening OPB which is opened at the cavity forming surface IS. The other end (not shown) of the second injection path IJB communicates with the material charge port (not shown) provided in the mold 500.

The injection paths IJA and IJB extend in parallel to the radial direction, at least in the vicinity of the injection openings OPA and OPB, respectively. The material injecting direction from the injection opening OPA, OPB into the cavity CV is a direction from radially outside to radially inside in parallel to the radial direction.

As shown in FIG. 3(A), the first injection opening OPA and the second injection opening OPB are located at different positions in the axial direction. Specifically, the position of the first injection opening OPA in the axial direction is the position of the maximum diameter portion IS2 of the cavity forming surface IS. The position of the second injection opening OPB in the axial direction is a substantially intermediate position between the front end of the cavity CV and the position of the first injection opening OPA in the axial direction.

As shown in FIG. 3(B), the first injection opening OPA and the second injection opening OPB are located at different positions in the circumferential direction. Specifically, assuming that the position of the first injection opening OPA in the circumferential direction is a position at 0°, the position of the second injection opening OPB in the circumferential direction is a position at 180°. That is, angles θb and θb' between the adjacent first injection opening OPA and second injection opening OPB are equal to each other, that is, 180°.

With the upper mold 510 and the lower mold 520 being closed, the bar-shaped member 530 is inserted into the rear end hole BH toward the inside of the cavity CV from the outside. The bar-shaped member 530 is fixed with the front end thereof being fitted in the front end hole FH. In this state, the front end portion of the bar-shaped member 530 fitted in the front end hole FH is supported by the front end hole forming surface that forms the front end hole FH, while the rear end portion of the bar-shaped member 530, located at the rear side with respect to the cavity CV, is supported by the rear end hole forming surface that forms the rear end hole BH. As a result, in the cavity CV, the bar-shaped member 530 is located at a position away from the cavity forming surface IS.

The mold 500 is mounted in an injection molding machine, and is set in a state in which the upper mold 510 and the lower mold 520 are closed and the bar-shaped member 530 is disposed in the cavity CV (i.e., the state shown in FIG. 3(A)).

At S3 in FIG. 2, the material containing a ceramic (specifically, alumina), prepared at S1, is injected into the cavity CV inside the mold 500. For example, the material heated to a predetermined temperature (e.g., 140° C.) is injected at a predetermined pressure (e.g., 600 kg/cm$^2$) from the material charge port of the mold 500. As a result, the material is injected into the cavity CV from the above-described injection openings OPA and OPB.

At S4 in FIG. 2, the material injected into the cavity CV is cooled and solidified in the cavity CV, whereby a molded product having the shape of the insulator 10 is formed. That is, the molded product, similar to the insulator 10, has a cylindrical shape having an axial hole (through-hole) extending in the axial direction.

At S5, the mold 500 is opened, and the molded product is taken out from the mold 500. Specifically, first, the bar-shaped member 530 is pulled out rightward in FIG. 3. Then, the upper mold 510 is slid in the upward direction UD with respect to the lower mold 520, and the molded product is taken out.

At S6, in a heat circulation furnace having atmospheric ambience, the molded product is heated over a predetermined period of time to degrease the molded product. Degreasing is a process of removing the binder from the molded product. For example, degreasing of the molded product is performed by increasing the temperature in the furnace from 30° C. to 400° C. at a heating rate of 10° C. per hour.

At S7, the degreased molded product is sintered by using a firing furnace to complete the insulator 10. For example, sintering of the molded product is performed by, for example, keeping the temperature inside the furnace at 1500° C. for two hours.

In the method for molding the insulator 10 for the spark plug according to the above-described embodiment, since the molded product is formed by using injection molding, it is possible to form the molded product into the same shape as the insulator 10 to be molded, with high accuracy. As a result, a grinding process for shaping a molded product before being sintered by grinding with a grinding roller (grindstone) can be dispensed with. For example, in the case where molded products are manufactured by pressure molding of ceramic powder, such a grinding process needs to be performed in order to obtain molded products having sufficient accuracy.

Since the grinding process is dispensed with, the particle size of the ceramic (specifically, alumina) powder used in the material can be made smaller than in the case where the grinding process is performed. This is because clogging of a grinding roller (grindstone) due to the ceramic powder does not occur. With reduction in the particle size of the ceramic powder, the mixing amount of the sintering additive can be reduced while maintaining the strength of the insulator 10. With reduction in the mixing amount of the sintering additive, dielectric strength property of the insulator 10 can be improved. As a result, improved dielectric strength property and downsizing of the spark plug 100 can be realized.

As described above, in the mold 500, the plurality of injection openings OPA and OPB are located at different positions in the axial direction. That is, in the injection step at S3 in FIG. 2, the material is injected into the cavity CV from the plurality of injection openings OPA and OPB located at different positions in the axial direction. As a result, reduction in dielectric strength property at the front end and the rear end of the insulator 10 can be suppressed. In particular, the front end portion of the insulator 10 (the leg portion 13 in FIG. 1) has a relatively small thickness in the radial direction of the insulator, and is closer to a firing end of the spark plug 100 than other parts. Therefore, the front end portion of the insulator 10 needs to have higher dielectric strength property than other parts. In this embodiment, reduction in dielectric strength property at the front end of the insulator 10 can be suppressed.

A specific description will be provided hereinafter. For example, the material injected from the injection openings OPA and OPB is filled in the cavity CV through routes indicated by arrows in FIGS. 3(A) and (B). At this time, the longer the movement distance of the material is, the longer the distance in which friction occurs between the wall surface of the cavity CV and the material is. In addition, the longer the movement distance of the material is, the more the material is solidified due to reduction in temperature of the material, and the more the viscosity of the material increases. As a result, the longer the movement distance of the material is, the more the pressure loss inside the cavity CV increases. Therefore, the longer the movement distance of the material is, the more the density of the front and rear end portions of the molded product tends to decrease. In the above embodiment, the material is injected into the cavity CV from the plurality of injection openings OPA and OPB located at different positions in the axial direction. As a result, as compared to the case where only one injection opening is provided or the case where a plurality of injection openings are located at the same position in the axial direction, the movement distance of the material in the axial direction, which is needed to fill the cavity CV up to the front end and the rear end thereof with the material, can be reduced. Therefore, reduction in density of the front and rear end portions of the molded product can be suppressed, thereby suppressing reduction in dielectric strength property of the front end and the rear end of the insulator 10 manufactured by using the molded product.

Further, the injection openings OPA and OPB are opened at a portion, of the cavity forming surface IS, other than the front end and the rear end, that is, at the inner circumferential surface that forms the cavity CV. In other words, the material is injected from the position corresponding to the side surface of the molded product, occurrence of burrs at the front end of the molded product can be suppressed. Since the molded product before being sintered (S7 in FIG. 2) is softer than that after being sintered, crack is likely to occur when burrs are removed. In the above embodiment, since occurrence of burrs is suppressed, a process of removing burrs can be omitted as much as possible. As a result, it is possible to suppress crack and/or breaking that may occur when burrs are removed.

Further, in the above embodiment, the plurality of injection openings OPA and OPB are located at different positions in the circumferential direction at the cavity forming surface IS. As a result, reduction in dielectric strength property at the front end and rear end of the insulator 10 can be suppressed.

A specific description will be provided hereinafter. As indicated by arrows in FIG. 3(B), in order to fill the cavity CV with the material injected into the cavity CV, the material also needs to move in the circumferential direction in the cavity CV. Since the plurality of injection openings OPA and OPB are located at different positions in the circumferential direction at the cavity forming surface IS, the movement distance in which the material injected into the cavity CV moves in the circumferential direction can be reduced. As a result, local reduction in density of the molded product can be suppressed. Therefore, reduction in dielectric strength property of the insulator 10 can be suppressed.

The plurality of injection openings OPA and OPB are disposed so that the angles in the circumferential direction between the adjacent injection openings in the circumferential direction are equal to each other. Specifically, in FIG. 3(B), angle $\theta b$=angle $\theta b'$=180° is satisfied. As a result, when the material is injected into the cavity CV, the distance in which the material moves in the circumferential direction can be further reduced. Therefore, reduction in dielectric strength property of the insulator 10 can be suppressed more effectively.

Of the plurality of injection openings OPA and OPB, one injection opening OPA is disposed at a position, in the axial direction, where the cavity CV has the maximum inner diameter, that is, in the maximum diameter portion IS2. At the position, in the axial direction, where the cavity CV has the maximum inner diameter, the movement distance of the material in the circumferential direction is maximum. Therefore, when the material is injected into the cavity CV, the movement distance in which the material moves in the circumferential direction becomes maximum at this position. In the above embodiment, since at least one injection opening OPA is disposed at this position, the movement distance in which the material moves in the circumferential direction can be reduced at this position. Therefore, in an insulator for a spark plug, which is manufactured by using the molded product, reduction in dielectric strength property can be suppressed more effectively.

Figure 4A:
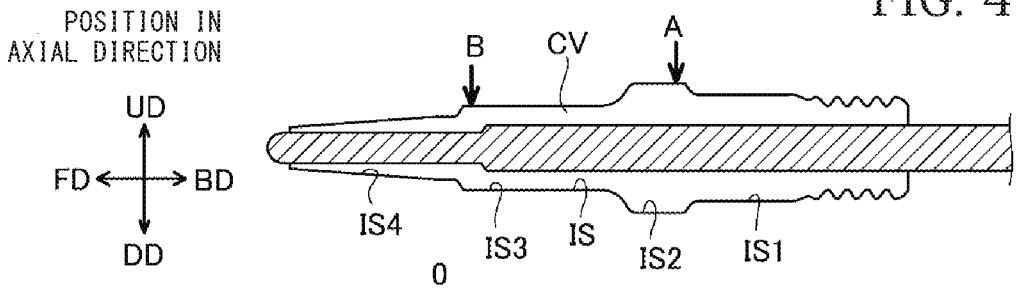
FIGS. 4(A) and 4(B) are simplified diagrams showing the position and number of injection openings according to a first embodiment.
Figure 4B:
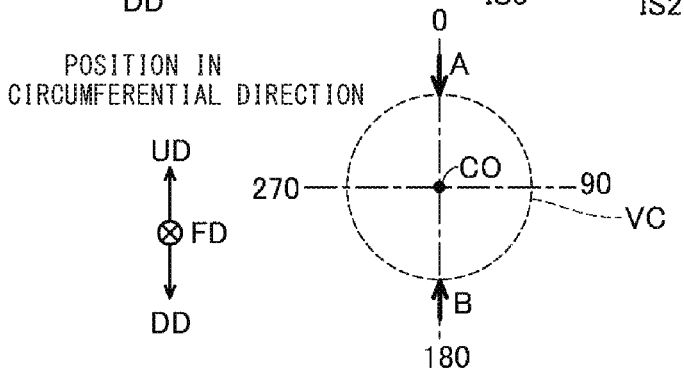

The positions of the two injection openings OPA and OPB in the above first embodiment can be expressed by using a simplified diagram shown in FIG. 4. FIG. 4 is a simplified diagram showing the positions and number of the injection openings according to the first embodiment. FIG. 4(A) shows only the bar-shaped member 530 and the cavity forming surface IS among the components shown in FIG. 3(A). In the simplified diagram of FIG. 4(A), the positions of the injection openings OPA and OPB in the axial direction at the cavity forming surface IS are indicated by using arrows A and B, respectively. In the simplified diagram of FIG. 4(B), only the axial line CO is shown among the components shown in FIG. 3(A). In FIG. 3(B), the positions of the injection openings OPA and OPB in the circumferential direction at the cavity forming surface IS are indicated by using arrows A and B on a virtual circle VC centered on the axial line CO.

In each of the second to tenth embodiments described below, the positions where injection paths and injection openings OP are located in the mold 500 and the number of the injection openings OP, that is, the injection positions at which the material is injected into the cavity CV at S2 in FIG. 2 and the number of the injection positions, are different from those of the first embodiment. Except for the positions and numbers of the injection openings, the components of the mold 500 and the steps in the manufacturing method shown in FIG. 2 according to the second to tenth embodiments are similar to those of the first embodiment. Therefore, in the second to tenth embodiments, only the positions of a plurality of injection openings will be described with reference to simplified diagrams similar to FIG. 4.

B. Second Embodiment

Figure 5A:
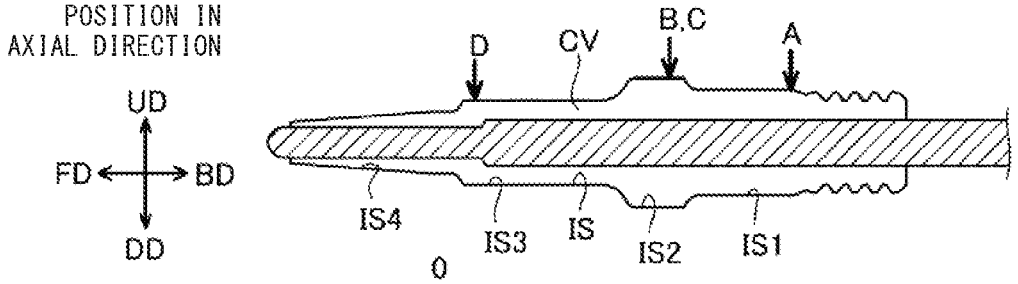
FIGS. 5(A) and 5(B) are simplified diagrams showing the position and number of injection openings according to a second embodiment.
Figure 5B:
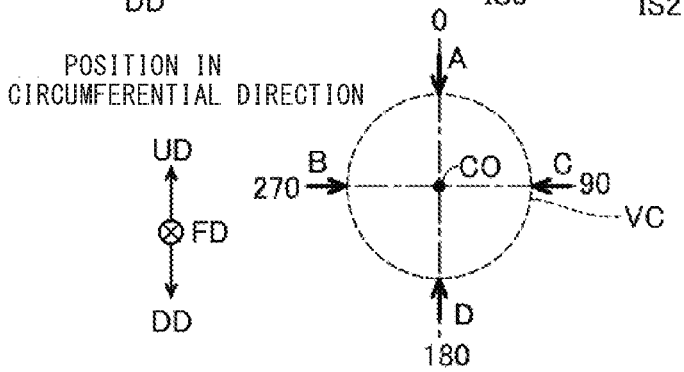

FIG. 5 is a simplified diagram showing the positions and number of injection openings according to the second embodiment. In the second embodiment, four injection openings OPA to OPD are provided in the mold. In FIG. 5(A), the positions of the four injection openings OPA to OPD in the axial direction are indicated by arrows A to D. In FIG. 5(B), the positions of the four injection openings OPA to OPD in the circumferential direction are indicated by arrows A to D.

Two injection openings OPB and OPC are located at a position, in the axial direction, where the cavity CV has the maximum inner diameter, that is, in the maximum diameter portion IS2 at the cavity forming surface IS. The positions of the two injection openings OPB and OPC in the circumferential direction are different from each other, and are a position at 90° and a position at 270°, respectively. That is, the two injection openings OPB and OPC are located at positions 180° apart from each other in the circumferential direction.

Further, two injection openings OPA and OPD are located at a position, in the axial direction, different from the position of the two injection openings OPB and OPC. Specifically, the injection opening OPA is located at a substantially intermediate position between the rear end of the cavity CV and the position, in the axial direction, where the two injection openings OPB and OPC are located. The injection opening OPD is located at a substantially intermediate position between the front end of the cavity CV and the position, in the axial direction, where the two injection openings OPB and OPC are located. Since the plurality of injection openings are located at the dispersed three positions in the axial direction, the movement distance of the material in the axial direction can be reduced.

The positions of the two injection openings OPA and OPD in the circumferential direction are different from each other, and also are different from the above-described positions of the two injection openings OPB and OPC. Specifically, the positions of the injection openings OPA and OPD in the circumferential direction are a position at 0° and a position at 180°, respectively. That is, the four injection openings OPA to OPD are located at positions 90° apart from each other in the circumferential direction so that the angles in the circumferential direction between the adjacent injection openings in the circumferential direction are equal to each other. Since the plurality of injection openings are located at the dispersed four positions in the circumferential direction, the movement distance of the material in the circumferential direction can be reduced.

Further, among the four injection openings OPA to OPD, the two injection openings OPB and OPD are located at the same position in the axial direction. As a result, at the position, in the axial direction, where the two injection openings OPB and OPD are located, the movement distance of the material in the circumferential direction can be further reduced. Therefore, in the insulator 10, reduction in dielectric strength property at this position can be suppressed more effectively.

Furthermore, since the two injection openings OPB and OPD are located in the maximum diameter portion IS2, the movement distance of the material in the circumferential direction can be reduced more effectively in the maximum diameter portion IS2 where the movement direction of the material in the circumferential direction tends to be long. Therefore, in the insulator 10, reduction in dielectric strength property at this position can be suppressed more effectively.

C. Third Embodiment

Figure 6A:
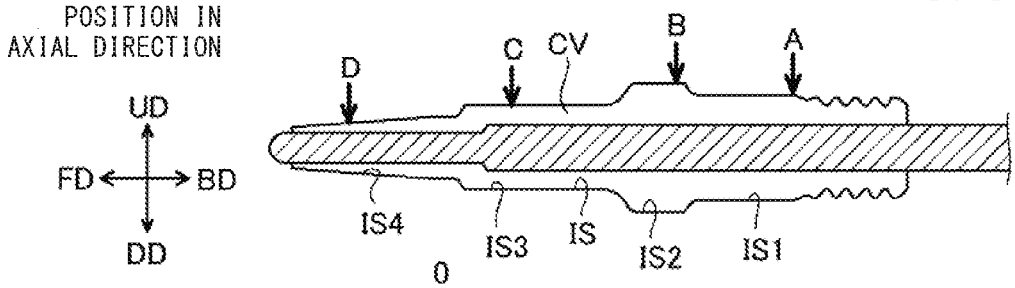
FIGS. 6(A) and 6(B) are simplified diagrams showing the position and number of injection openings according to a third embodiment.
Figure 6B:
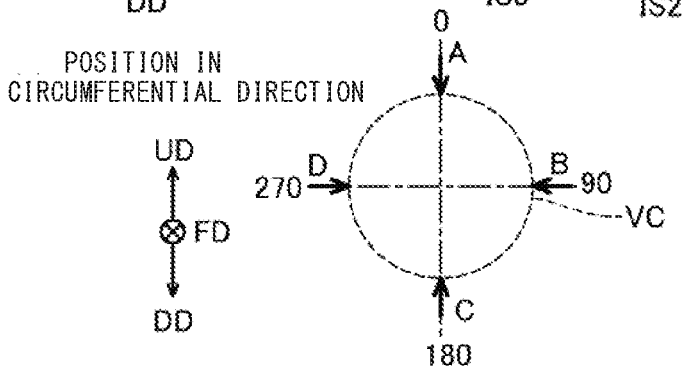

FIG. 6 is a simplified diagram showing the positions and number of injection openings according to the third embodiment. In the third embodiment, four injection openings OPA to OPD are provided in the mold. In FIG. 6(A), the positions of the four injection openings OPA to OPD in the axial direction are indicated by arrows A to D. In FIG. 6(B), the positions of the four injection openings OPA to OPD in the circumferential direction are indicated by arrows A to D.

The positions of the four injection openings OPA to OPD in the axial direction are different from each other. The injection opening OPB is located at a position, in the axial direction, where the cavity CV has the maximum inner diameter, that is, in the maximum diameter portion IS2 at the cavity forming surface IS.

The injection opening OPD is located at a position, in the axial direction, relatively close to the front end of the cavity CV, that is, in the diameter-decreasing portion IS4 at the cavity forming surface IS. As a result, reduction in density of the molded product can be suppressed in the front end portion (leg portion 13) of the insulator 10, which portion is desired to have higher dielectric strength property than other parts. Therefore, the dielectric strength property of the front end portion of the insulator 10 can be effectively improved.

The injection opening OPA is located at a substantially intermediate position between the rear end of the cavity CV and the position of the injection opening OPB in the axial direction. The injection opening OPC is located at a substantially intermediate position between the position of the injection opening OPB in the axial direction and the position of the injection opening OPD in the axial direction. Since the four injection openings are located at the dispersed four positions in the axial direction, the movement distance of the material in the axial direction can be reduced.

The positions of the four injection openings OPA to OPD in the circumferential direction are different from each other, and are a position at 0°, a position at 90°, a position at 180°, and a position at 270°, respectively. That is, the four injection openings OPA to OPD are arranged so that the positions thereof in the circumferential direction are 90° shifted from one another, clockwise from the rear end of the cavity forming surface IS toward the front end direction FD. In other words, the four injection openings OPA to OPD are arranged in a helical manner centered on the axial direction CO. As a result, the four injection openings can be located at the four positions appropriately dispersed in the circumferential direction. Thus, when the material is injected into the cavity CV, the movement distance in which the material moves in the circumferential direction can be further reduced. Therefore, reduction in dielectric strength property of the insulator 10 can be suppressed more effectively.

D. Fourth Embodiment

Figure 7A:
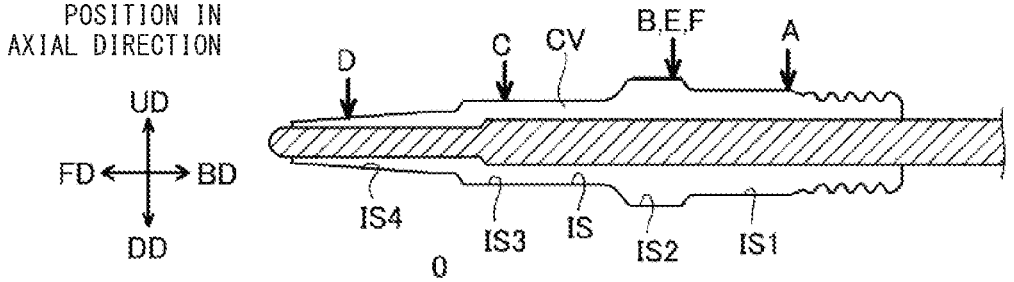
FIGS. 7(A) and 7(B) are simplified diagrams showing the position and number of injection openings according to a fourth embodiment.
Figure 7B:
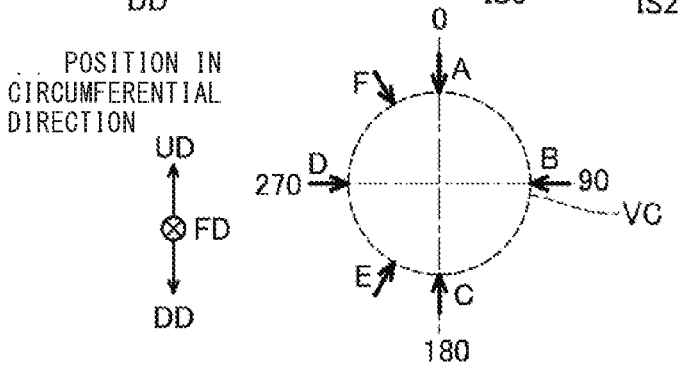

FIG. 7 is a simplified diagram showing the positions and number of injection openings according to the fourth embodiment. In the fourth embodiment, six injection openings OPA to OPF are provided in the mold. In FIG. 7(A), the positions of the six injection openings OPA to OPF in the axial direction are indicated by arrows A to F. In FIG. 7(B), the positions of the six injection openings OPA to OPF in the circumferential direction are indicated by arrows A to F.

The positions of the four injection openings OPA to OPD are the same as those in the third embodiment. In this fourth embodiment, more two injection openings OPE and OPF are additionally located at the position, in the axial direction, where the cavity CV has the maximum inner diameter, that is, in the maximum diameter portion IS2 at the cavity forming surface IS.

The positions, in the circumferential direction, of the three injection openings OPB, OPE, and OPF located in the maximum diameter portion IS2 are different from each other, and are a position at 90°, a position at 210°, and a position at 330°, respectively. That is, the three injection openings OPB, OPE, and OPF are located at positions 120° apart from each other in the circumferential direction so that the angles in the circumferential direction between the adjacent injection openings in the circumferential direction are equal to each other. Since, in the maximum diameter portion IS2, the plurality of injection openings are located at the dispersed three positions in the circumferential direction, the movement distance of the material in the circumferential direction can be reduced in the maximum diameter portion IS2. As a result, as compared to the third embodiment, reduction in dielectric strength property of the portion (flange portion 19 (FIG. 1)), of the insulator 10, having the maximum outer diameter can be appropriately suppressed. Therefore, for example, the fourth embodiment is more effective in the case where the outer diameter of the portion, of the insulator 10, having the maximum outer diameter is significantly greater than the outer diameters of other portions.

E. Fifth Embodiment

Figure 8A:
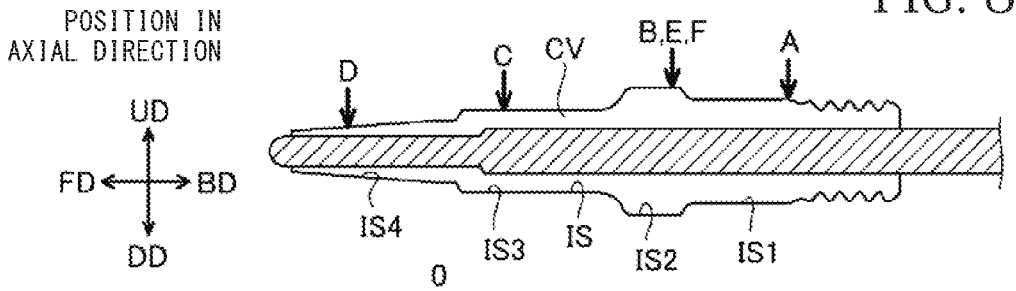
FIGS. 8(A) and 8(B) are simplified diagrams showing the position and number of injection openings according to a fifth embodiment.
Figure 8B:
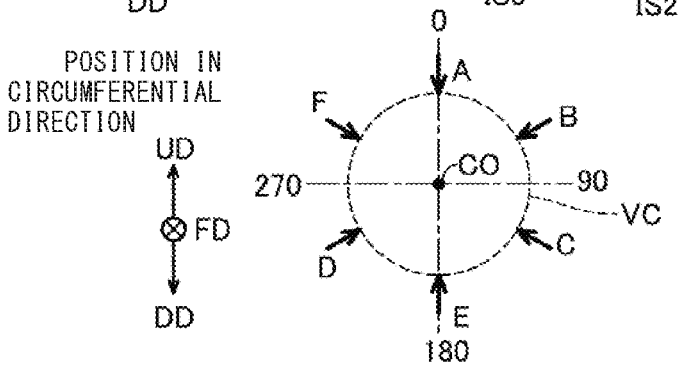

FIG. 8 is a simplified diagram showing the positions and number of injection openings according to the fifth embodiment. In the fifth embodiment, six injection openings OPA to OPF are provided in the mold. In FIG. 8(A), the positions of the six injection openings OPA to OPF in the axial direction are indicated by arrows A to F. In FIG. 8(B), the positions of the six injection openings OPA to OPF in the circumferential direction are indicated by arrows A to F.

The positions of the six injection openings OPA to OPF in the axial direction are the same as the positions of the six injection openings OPA to OPF in the axial direction according to the fourth embodiment.

The positions, in the circumferential direction, of three injection openings OPB, OPE, and OPF located in the maximum diameter portion IS2 are different from each other, and are a position at 60°, a position at 180°, and a position at 300°, respectively. That is, similarly to the fourth embodiment, the three injection openings OPB, OPE, and OPF are located at positions 120° apart from each other in the circumferential direction so that the angles in the circumferential direction between the adjacent injection openings in the circumferential direction are equal to each other.

The positions, in the circumferential direction, of three injection openings OPA, OPC, and OPD located at positions in the axial direction other than the maximum diameter portion IS2 are different from each other, and are a position at 0°, a position at 120°, and a position at 240°, respectively. That is, the three injection openings OPA, OPC, and OPD are, similarly to the other three injection openings OPB, OPE, and OPF, located at positions 120° apart from each other in the circumferential direction so that the angles in the circumferential direction between the adjacent injection openings in the circumferential direction are equal to each other.

The positions, in the circumferential direction, of the three injection openings OPB, OPE, and OPF located in the maximum diameter portion IS2, and the positions, in the circumferential direction, of the three injection openings OPA, OPC, and OPD located at the positions in the axial direction outside the maximum diameter portion IS2 are 60° shifted from each other. As a result, the positions of the six injection openings OPA to OPF are different from each other, and the six injection openings OPA to OPF are located at positions 60° apart from each other in the circumferential direction so that the angles in the circumferential direction between the adjacent injection openings in the circumferential direction are equal to each other.

In other words, in the fifth embodiment, the six injection openings OPA to OPF are located at the dispersed four positions in the axial direction, and located at the dispersed six positions in the circumferential direction. As a result, the material is injected into the cavity CV from the appropriately dispersed six injection openings OPA to OPF, whereby the movement directions of the material in the axial direction and the circumferential direction can be appropriately reduced. As a result, local reduction in dielectric strength property of the insulator 10 can be suppressed more effectively.

F. Sixth Embodiment

Figure 9A:
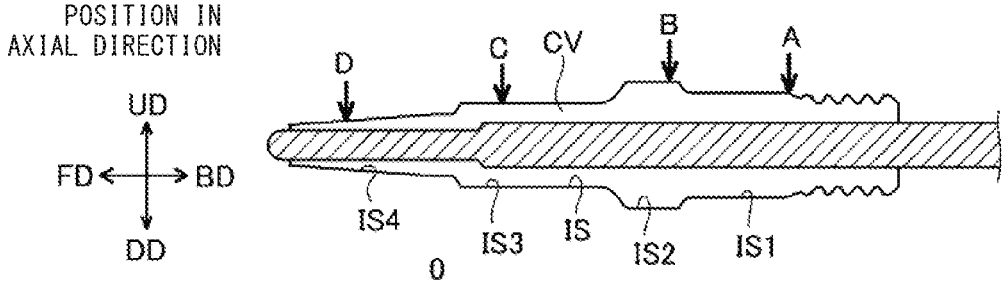
FIGS. 9(A) and 9(B) are simplified diagrams showing the position and number of injection openings according to a sixth embodiment.
Figure 9B:
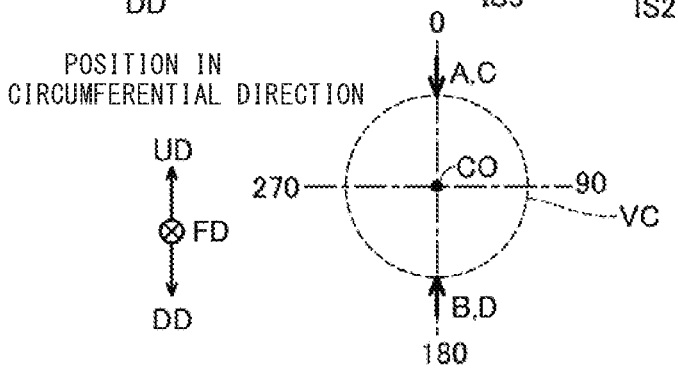

FIG. 9 is a simplified diagram showing the positions and number of injection openings according to the sixth embodiment. In the sixth embodiment, four injection openings OPA to OPD are provided in the mold. In FIG. 9(A), the positions of the four injection openings OPA to OPD in the axial direction are indicated by arrows A to D. In FIG. 9(B), the positions of the four injection openings OPA to OPD in the circumferential direction are indicated by arrows A to D.

The positions of the four injection openings OPA to OPD in the axial direction are the same as those in the third embodiment.

Among the four injection openings OPA to OPD, two injection openings OPA and OPC are located at the same position in the circumferential direction, which is a position at 0°. The remaining two injection openings OPB and OPD are located at the same position in the circumferential direction, which is a position at 180°. That is, the position of the two injection openings OPB and OPD in the circumferential direction is opposed to the position of the two injection openings OPA and OPC across the axial line CO.

In this embodiment, the four injection openings can be located at four positions that are appropriately dispersed in the axial direction. In addition, the material can be injected into the cavity CV from the both sides (the upper side and the lower side in FIG. 9(B)) across the axial line CO. Further, one injection opening OPB is located in the maximum diameter portion IS2. As a result, the movement distance in which the material moves in the cavity CV can be appropriately reduced. Therefore, reduction in dielectric strength property of the insulator 10 can be suppressed.

G. Seventh Embodiment

Figure 10A:
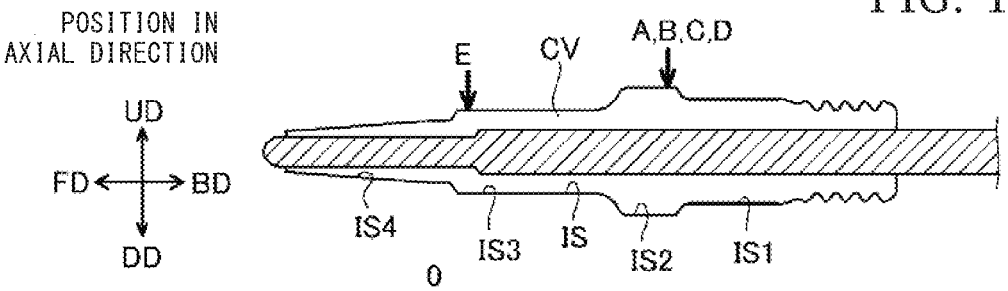
FIGS. 10(A) and 10(B) are simplified diagrams showing the position and number of injection openings according to a seventh embodiment.
Figure 10B:
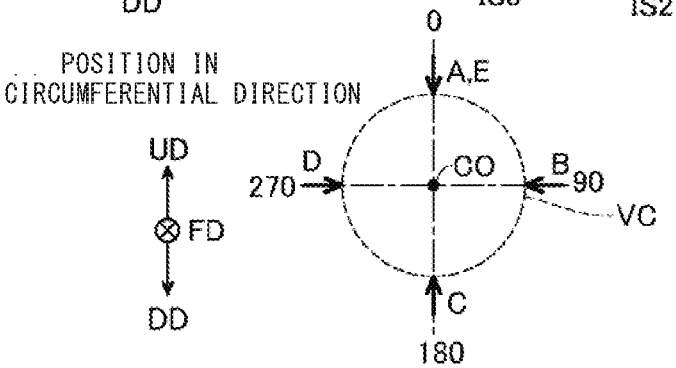

FIG. 10 is a simplified diagram showing the positions and number of injection openings according to the seventh embodiment. In the seventh embodiment, five injection openings OPA to OPE are provided in the mold. In FIG. 10(A), the positions of the five injection openings OPA to OPE in the axial direction are indicated by arrows A to E. In FIG. 10(B), the positions of the five injection openings OPA to OPE in the circumferential direction are indicated by arrows A to E.

Four injection openings OPA to OPD are located at a position, in the axial direction, where the cavity CV has the maximum inner diameter, that is, in the maximum diameter portion IS2 at the cavity forming surface IS. One injection opening OPE is located at a substantially intermediate position between the front end of the cavity CV and the position, in the axial direction, where the four injection openings OPA to OPD are located.

The four injection openings OPA to OPD are located at positions 90° apart from each other in the circumferential direction so that the angles in the circumferential direction between the adjacent injection openings in the circumferential direction are equal to each other. The position of the one injection opening OPE in the circumferential direction is the same as the position of the injection opening OPA.

In this embodiment, the four injection openings are located in the maximum diameter portion IS2 at the four dispersed positions in the circumferential direction. Therefore, particularly in the maximum diameter portion IS2, the movement direction of the material in the circumferential direction can be reduced. Thus, reduction in dielectric strength property of the portion (flange portion 19 (FIG. 1)), of the insulator 10, having the maximum outer diameter can be appropriately suppressed. Therefore, the seventh embodiment is more effective in the case where the outer diameter of the portion, of the insulator 10, having the maximum outer diameter is significantly greater than the outer diameters of other portions.

H. Eighth Embodiment

Figure 11A:
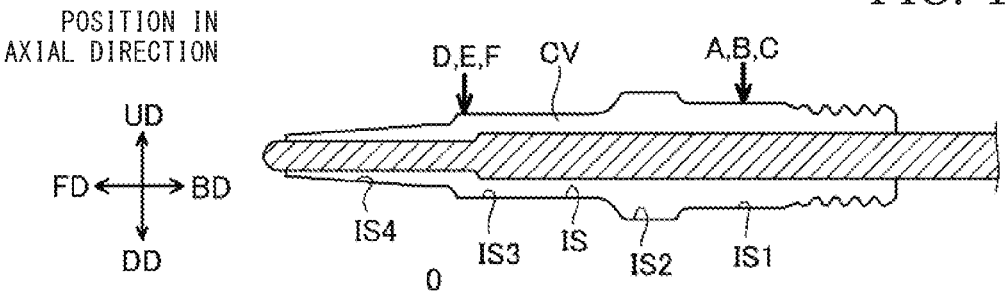
FIGS. 11(A) and 11(B) are simplified diagrams showing the position and number of injection openings according to an eighth embodiment.
Figure 11B:
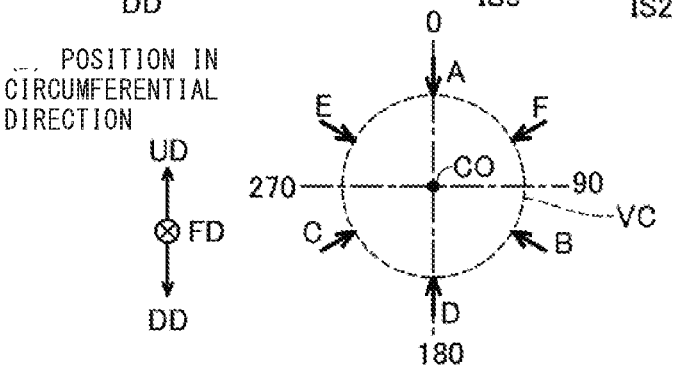

FIG. 11 is a simplified diagram showing the positions and number of injection openings according to the eighth embodiment. In the eighth embodiment, six injection openings OPA to OPF are provided in the mold. In FIG. 11(A), the positions of the six injection openings OPA to OPF in the axial direction are indicated by arrows A to F. In FIG. 11(B), the positions of the six injection openings OPA to OPF in the circumferential direction are indicated by arrows A to F.

Three injection openings OPA to OPC are located at a substantially intermediate position between the center of the cavity CV in the axial direction and the rear end of the cavity CV. Three injection openings OPD to OPF are located at a substantially intermediate position between the center of the cavity CV in the axial direction and the front end of the cavity CV.

The positions of the three injection openings OPA to OPC in the circumferential direction are different from each other, and are a position at 0°, a position at 120°, and a position at 240°, respectively. That is, the three injection openings OPA to OPC are located at positions 120° apart from each other in the circumferential direction so that the angles in the circumferential direction between the adjacent injection openings in the circumferential direction are equal to each other.

The positions of the three injection openings OPD to OPF in the circumferential direction are different from each other, and are a position at 180°, a position at 300°, and a position at 60°, respectively. That is, the three injection openings OPD to OPF are located at positions 120° shifted from each other in the circumferential direction so that the angles in the circumferential direction between the adjacent injection openings in the circumferential direction are equal to each other.

The positions of the three injection openings OPA to OPC in the circumferential direction and the positions of the three injection openings OPD to OPF in the circumferential direction are 60° shifted from each other. As a result, the six injection openings OPA to OPF are located at positions 60° apart from each other in the circumferential direction so that the angles in the circumferential direction between the adjacent injection openings in the circumferential direction are equal to each other.

In this embodiment, the six injection openings OPA to OPF are located at two dispersed positions in the axial direction, and at six dispersed positions in the circumferential direction. As a result, the movement distances of the material in both the axial direction and the circumferential direction can be appropriately reduced. As a result, local reduction in dielectric strength property of the insulator 10 can be suppressed more effectively.

I. Ninth Embodiment

Figure 12A:
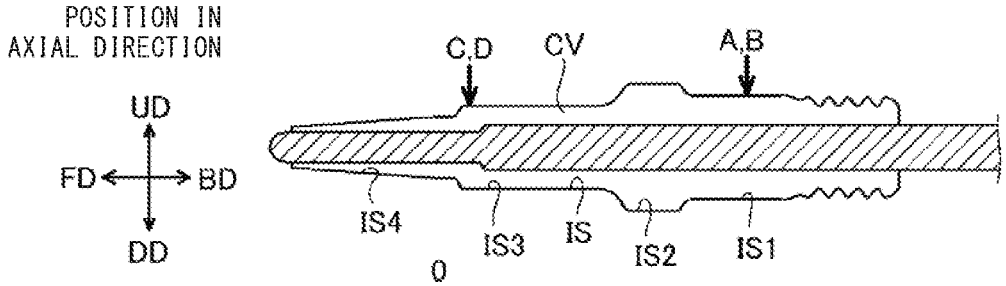
FIGS. 12(A) and 12(B) are simplified diagrams showing the position and number of injection openings according to a ninth embodiment.
Figure 12B:
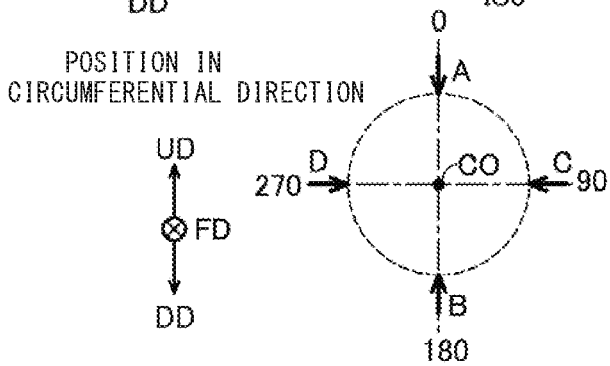

FIG. 12 is a simplified diagram showing the positions and number of injection openings according to the ninth embodiment. In the ninth embodiment, four injection openings OPA to OPD are provided in the mold. In FIG. 12(A), the positions of the four injection openings OPA to OPD in the axial direction are indicated by arrows A to D. In FIG. 12(B), the positions of the four injection openings OPA to OPD in the circumferential direction are indicated by arrows A to D.

The position of two injection openings OPA and OPB in the circumferential direction is the same as the position of the three injection openings OPA to OPC in the eighth embodiment. The position of two injection openings OPC and OPD in the circumferential direction is the same as the position of the three injection openings OPD to OPF in the eighth embodiment.

The positions of the two injection openings OPA and OPB in the axial direction are different from each other, and are a position at 0° and a position at 180°, respectively. That is, the injection opening OPA and the injection opening OPB are opposed to each other across the axial line CO. In addition, the positions of the two injection openings OPC and OPD in the axial direction are different from each other, and are a position at 90° and a position at 270°, respectively. That is, the injection opening OPC and the injection opening OPD are opposed to each other across the axial line CO. The four injection openings OPA to OPD are located at positions 90° apart from each other in the circumferential direction so that the angles in the circumferential direction between the adjacent injection openings in the circumferential direction are equal to each other.

In this embodiment, the four injection openings OPA to OPD are located at two dispersed positions in the axial direction, and at four dispersed positions in the circumferential direction. As a result, the movement distances of the material in both the axial direction and the circumferential direction can be appropriately reduced. As a result, local reduction in dielectric strength property of the insulator 10 can be suppressed more effectively.

J. Tenth Embodiment

Figure 13A:
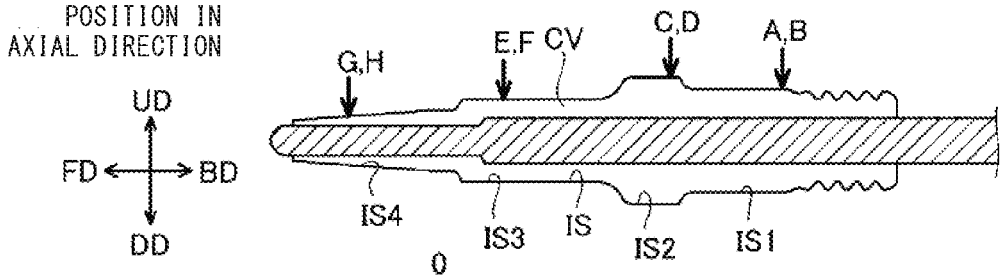
FIGS. 13(A) and 13(B) are simplified diagrams showing the position and number of injection openings according to a tenth embodiment.
Figure 13B:
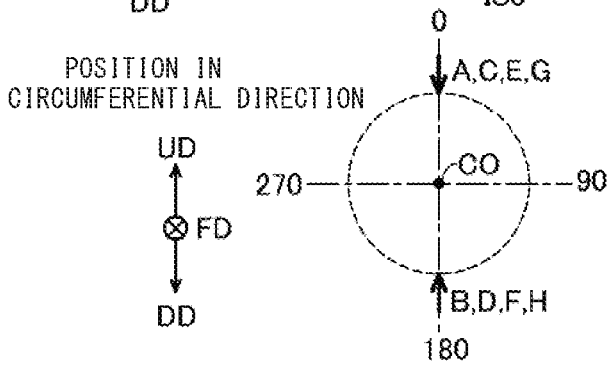

FIG. 13 is a simplified diagram showing the positions and number of injection openings according to the tenth embodiment. In the tenth embodiment, eight injection openings OPA to OPH are provided in the mold. In FIG. 13(A), the positions of the eight injection openings OPA to OPH in the axial direction are indicated by arrows A to H. In FIG. 13(B), the positions of the eight injection openings OPA to OPH in the circumferential direction are indicated by arrows A to H.

The position of two injection openings OPA and OPB in the axial direction is the same as the position of the injection opening OPA in the sixth embodiment. The position of two injection openings OPC and OPD in the axial direction is the same as the position of the injection opening OPB in the sixth embodiment. The position of two injection openings OPE and OPF in the axial direction is the same as the position of the injection opening OPC in the sixth embodiment. The position of two injection openings OPG and OPH in the axial direction is the same as the position of the injection opening OPD in the sixth embodiment.

The positions, in the circumferential direction, of the two injection openings located at the same position in the axial direction are different from each other, and are a position at 0° and a position at 180°, respectively. That is, the two injection openings located at the same position in the axial direction are opposed to each other across the axial line CO.

In this embodiment, the eight injection openings OPA to OPH are located at four dispersed positions in the axial direction. The material can be injected into the cavity CV from the both sides (the upper side and the lower side in FIG. 13(B)) across the axial line CO. In addition, the two injection openings OPC and OPD are located in the maximum diameter portion IS2. As a result, the movement distance in which the material moves in the cavity CV can be appropriately reduced. Therefore, reduction in dielectric strength property of the insulator 10 can be suppressed.

K. Modified Embodiments (1) The shapes of the insulator 10 according to the above embodiments are merely examples, and the insulator 10 of the present invention is not limited thereto. The radial thicknesses of the respective parts 13, 17, 18, and 19 of the insulator 10, the axial lengths of the respective parts 13, 17, 18, and 19, the diameter of the through-hole 12, or the like may be changed as appropriate. The shape of the cavity CV formed inside the mold 500 may be changed according to the specific shape of the insulator 10. The number, position, and size of injection openings to be formed at the cavity forming surface IS are determined as appropriate according to the shape of the cavity CV. At this time, the movement distance of the material in the cavity CV, the degree of friction applied to the material by the cavity forming surface IS in the cavity CV, and the like are considered.

(2) The material used in the above embodiments is merely an example, and the material of the present invention is not limited thereto. For example, regarding a ceramic as a principal component of the material, one or some of AlN, $ZrO_2$, SiC, $TiO_2$, and $Y_2O_3$ may be used instead of alumina ($Al_2O_3$). Likewise, the types and amounts of a sintering additive and a binder contained in the material may be changed as appropriate. When the material is changed, flow characteristics (e.g., viscosity) of the material in the cavity CV during injection molding also change. The number, position, and size of injection openings to be formed at the cavity forming surface IS may be changed as appropriate according to the flow characteristics of the material in the cavity CV (3) The specific structure of the mold 500 shown in FIG. 3 is merely an example, and the structure of the mold 500 of the present invention is not limited thereto. For example, the upper mold 510 shown in FIG. 3 may be divided into a plurality of molds arranged side by side in the axial direction. The bar-shaped member 530 may be divided into two parts, and the respective parts may be inserted into the cavity CV one by one from the front side and the rear side. In the mold 500, the axial direction may be set in parallel to the direction of gravity, or may be set perpendicularly to the direction of gravity. The number, position, and size of injection openings to be formed at the cavity forming surface IS are changed as appropriate according to the structure of the mold. For example, in the case where the axial direction is set in parallel to the direction of gravity in the mold 500, the plurality of injection openings preferably include two or more injection openings located at different positions in the circumferential direction. In the case where the axial direction is set perpendicularly to the direction of gravity in the mold 500, the plurality of injection openings preferably include two or more injection openings located at different positions in the axial direction. That is, the plurality of injection openings preferably include a plurality of injection openings located at different positions in a direction in which movement of the material due to gravity cannot be expected.

(4) The respective conditions (e.g., the material heating temperature and the material injecting pressure) of the injection molding according to the above-described embodiments are merely examples, and the conditions of injection molding of the present invention are not limited thereto. These conditions may be changed as appropriate according to the type of a material to be used, the shape of an insulator 10 to be molded, the type of a molding machine to be used, the structure of the mold 500, or the like.

Although the present invention has been described above on the basis of the embodiments and the modifications, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5 . . . gasket
6 . . . ring member
8 . . . plate packing
9 . . . talc
10 . . . insulator
12 . . . through-hole
13 . . . leg portion
15 . . . step portion
16 . . . step portion
17 . . . front trunk portion
18 . . . rear trunk portion
19 . . . flange portion
20 . . . center electrode
21 . . . center electrode body
21A . . . electrode base material
21B . . . core portion
23 . . . head portion
24 . . . flange portion
25 . . . leg portion
29 . . . center electrode tip
30 . . . ground electrode
31 . . . ground electrode body
39 . . . ground electrode tip
40 . . . metal terminal
41 . . . cap mounting portion
42 . . . flange portion
43 . . . leg portion
50 . . . metal shell
51 . . . tool engagement portion
52 . . . mounting screw portion
53 . . . crimp portion
54 . . . seat portion
56 . . . step portion
58 . . . compressive deformation portion
59 . . . insertion hole
60 . . . conductive seal
70 . . . resistor
80 . . . conductive seal
100 . . . spark plug
500 . . . mold
510 . . . upper mold
511 . . . upper cavity forming surface
512 . . . upper rear end hole forming surface
513 . . . upper front end hole forming surface
520 . . . lower mold
521 . . . lower cavity forming surface
522 . . . lower rear end hole forming surface
523 . . . lower front end hole forming surface
530 . . . bar-shaped member
OPA to OPH . . . injection opening
IS . . . cavity forming surface
CV . . . cavity
IJA, IJB . . . injection path Having described the invention, the following is claimed:

1. A method for manufacturing an insulator for a spark plug, the method including a molding process of forming a cylindrical molded product having an axial hole that extends in a direction of an axial line, by means of injection molding using a mold that has a columnar cavity therein, and a bar-shaped member disposed in the cavity and extending in the direction of the axial line, wherein the molding process includes an injection step of injecting a material containing a ceramic, in the injection step, the material is injected into the cavity from a plurality of injection openings that are opened at an inner circumferential surface, of the mold, that forms the cavity, and the plurality of injection openings include three or more injection openings located at different positions in the direction of the axial line, wherein the plurality of injection openings include three or more injection openings located at different positions in a circumferential direction at the inner circumferential surface, of the mold, that forms the cavity, wherein the plurality of injection openings are located so that angles thereof in the circumferential direction between adjacent injection openings in the circumferential direction are equal to each other, and the plurality of injection openings are arranged in a helical manner at the inner circumferential surface, of the mold, that forms the cavity.

2. A method for manufacturing an insulator for a spark plug, the method including a molding process of forming a cylindrical molded product having an axial hole that extends in a direction of an axial line, by means of injection molding using a mold that has a columnar cavity therein, and a bar-shaped member disposed in the cavity and extending in the direction of the axial line, wherein the molding process includes an injection step of injecting a material containing a ceramic, in the injection step, the material is injected into the cavity from a plurality of injection openings that are opened at an inner circumferential surface, of the mold, that forms the cavity, and the plurality of injection openings include three or more injection openings located at different positions in a circumferential direction at the inner circumferential surface, of the mold, that forms the cavity, wherein the plurality of injection openings are located so that angles thereof in the circumferential direction between adjacent injection openings in the circumferential direction are equal to each other, and the plurality of injection openings are arranged in a helical manner at the inner circumferential surface, of the mold, that forms the cavity.

3. The method for manufacturing the insulator for the spark plug according to claim 1, wherein at least one of the plurality of injection openings is located at a position, in the direction of the axial line, where the cavity has a maximum inner diameter.

4. The method for manufacturing the insulator for the spark plug according to claim 1, wherein at least two of the plurality of injection openings are located at the same position in the direction of the axial line.

5. The method for manufacturing the insulator for the spark plug according to claim 3, wherein at least two injection openings, the positions in the direction of the axial line of which are the same, are located at the position, in the direction of the axial line, at which the cavity has the maximum inner diameter.

6. The method according to claim 1, wherein the circumferential direction is a direction perpendicular to the circumferential surface.

7. The method according to claim 1, wherein the circumferential surface arranged radially out from the axial line.

* * * * *